United States Patent [19]

Chapman et al.

[11] 4,422,228

[45] Dec. 27, 1983

[54] MOLDBOARD BIT INSTALLING TOOL AND METHOD

[76] Inventors: Orville B. Chapman, Box 414, Chewelah, Wash. 99109; George O. Prufer, Rte. 2, Box 488, Deer Park, Wash. 99006

[21] Appl. No.: 277,235

[22] Filed: Jun. 25, 1981

[51] Int. Cl.[3] ..... B21H 7/00; B21K 19/00

[52] U.S. Cl. ..... 29/148.3; 29/526 R; 29/464; 29/244; 254/380

[58] Field of Search ..... 29/148.3, 526 R, 433, 29/244, 469, 464; 254/380; 37/193; 172/701.3

[56] References Cited

U.S. PATENT DOCUMENTS

| | | | |
|---|---|---|---|
| 207,746 | 9/1878 | King | 254/380 X |
| 1,922,917 | 8/1933 | Russell et al. | 29/148.3 X |
| 2,213,310 | 9/1940 | Gimenez et al. | 29/244 X |
| 2,787,051 | 4/1957 | Risley | 29/526 R X |
| 3,239,928 | 3/1966 | Baker | 29/433 |
| 3,263,320 | 8/1966 | Jones | 29/526 R X |
| 3,361,411 | 1/1968 | Reigh | 254/380 X |
| 3,611,549 | 10/1971 | Pope | 29/433 |
| 3,745,640 | 7/1973 | Caroleo | 29/469 X |
| 3,868,189 | 2/1975 | King, Jr. | 29/526 R X |
| 3,934,855 | 1/1976 | Patterson et al. | 254/380 X |

*Primary Examiner*—Charlie T. Moon

*Attorney, Agent, or Firm*—Wells, St. John & Roberts

[57] ABSTRACT

A method and apparatus for installing an apertured moldboard bit to a similarly apertured moldboard. The bit installing tool includes a handle operated winch drum mounted to a winch frame for winding and unwinding a cable. The winch frame is connected to a base frame and the base frame secures the tool to the moldboard. The cable has means at a free end for releasably securing the bit for hoisting to the moldboard. The bit installing tool is affixed to the moldboard. The cable is extended from the tool and threaded through apertures in the moldboard and the bit. The cable is secured to the bit, the bit is hoisted to the moldboard by winding the cable about a winch drum, and the bit is bolted to the moldboard. Bit removal may be accomplished by reversing the above steps.

7 Claims, 6 Drawing Figures

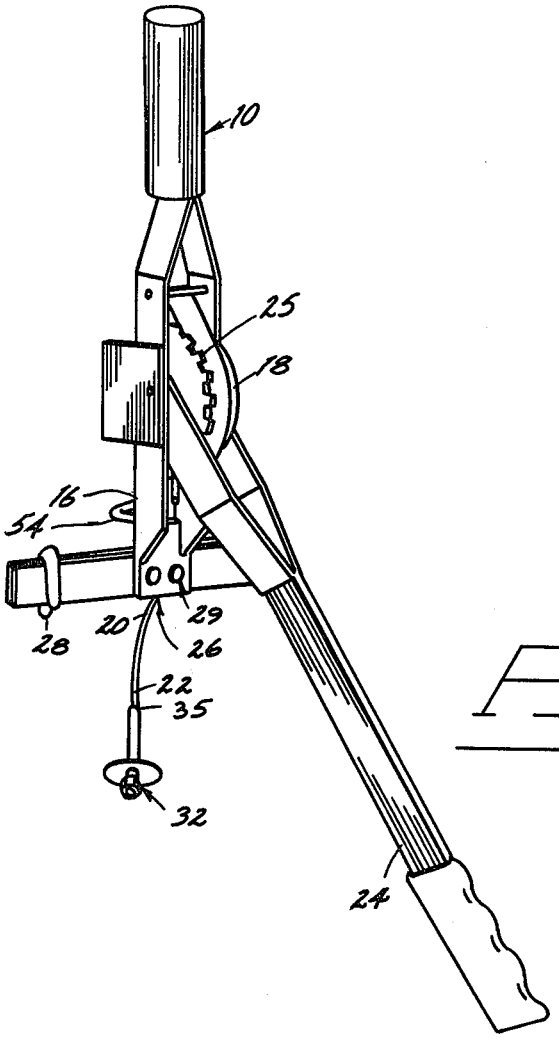
FIG 1
FIG 2
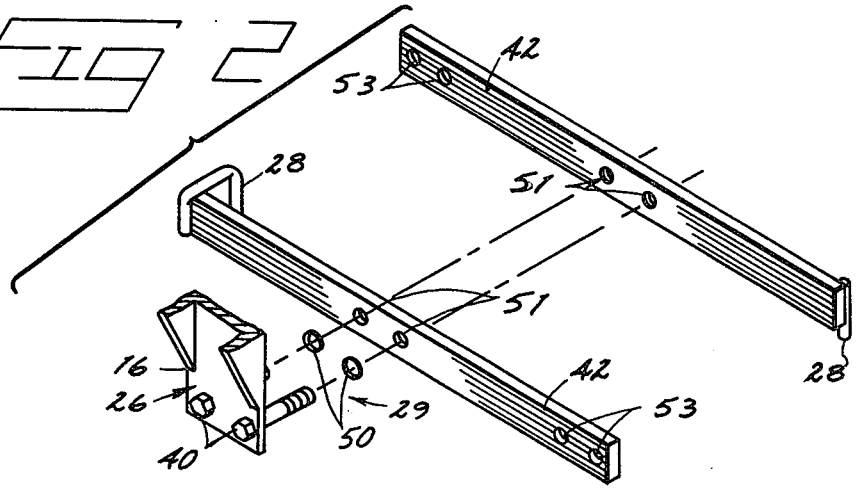

MOLDBOARD BIT INSTALLING TOOL AND METHOD

TECHNICAL FIELD

This invention relates to tools for installing moldboard bits.

BACKGROUND ART

Construction equipment, such as road graders, and agricultural and other equipment which includes a moldboard require replaceable bits at the wear points where the machine performs work. The bit is usually secured to the moldboard by bolts or other releasable securing means. The machinery is often quite large and the bits are quite heavy, ranging in weight from a few pounds to over 125 pounds.

Removing and installing the heavy bits is often too arduous for one person. Common practice is to have a person at each end of the bit hold it in position while a third person bolts or unbolts the bit to or from the moldboard.

Much economy, in terms of man hours, would be obtained if installation of a bit to a moldboard were a one man task. Furthermore, performing the job would be much safer. Workers would not have to do heavy lifting or be subjected to its resultant risks. The possibility of dropping the bit and injuring someone would be considerably reduced.

It is an object of this invention to provide a tool for removing and installing a moldboard bit to a moldboard quickly and safely, the installation being performed by one person.

Various other objects and advantages will become apparent upon reading the following description which, when taken with the accompanying drawings, describe a preferred form of the invention. It is to be noted, however, that the following description and drawings are given merely to set forth the preferred form of the invention and that alterations may be made.

DISCLOSURE OF INVENTION

The present invention involves a tool and method for installing an elongated apertured bit to a similarly apertured moldboard with a moldboard bit installing tool.

The moldboard bit installing tool is used for hoisting and lowering an elongated, apertured bit to and from a mounting position in relation to a similarly apertured moldboard. The bit installing tool comprises a winch frame, a winch drum rotatably mounted to the winch frame, a winch cable on the winch drum (the cable extending to a free end), and handle means operably connected to the winch drum for forcibly rotating the winch drum to wind and unwind the cable on the drum.

The tool has an elongated base frame mounted to the winch frame. On the base frame are outwardly projecting studs. Each stud is spaced from the other by a multiple of the distance corresponding to the spacing between the apertures on the moldboard. The studs are received through appropriate apertures on the moldboard such that the cable on the drum is aligned with an aperture on the moldboard. There is a cable terminal affixed to the free end of the cable. The terminal is adapted to be inserted through corresponding moldboard and moldboard bit apertures. There are means on the cable terminal for releasably securing the cable terminal to the moldboard bit through an aperture in the moldboard bit.

Installing the bit to the moldboard involves securing the moldboard bit installing tool to a back surface of the moldboard by inserting the outwardly projecting studs on the base frame of the tool into mating moldboard apertures. The winch cable terminal is inserted through an aperture in the moldboard and through a corresponding aperture in the bit. The cable free end is secured to the bit by the cable. The bit is hoisted into mounting position by winding the cable about the winch drum of the bit installing tool. Once in position, the bit is secured by bolts. The cable free end is removed from the bit after the bolts are installed by releasing the terminal. The tool is removed from the moldboard and bolts are installed through the apertures remaining where the tool studs and cable terminal had been.

Removal of an old worn bit from a moldboard is accomplished by reversing the above process, first removing the bolts where the studs and cable terminal are to be inserted.

BRIEF DESCRIPTION OF THE DRAWINGS

A preferred embodiment of the invention is illustrated in the accompanying drawings in which:

FIG. 1 is an isometric view of the invention;
FIG. 2 is an exploded view of the base frame.

BEST MODE FOR CARRYING OUT THE INVENTION

Figure 3:
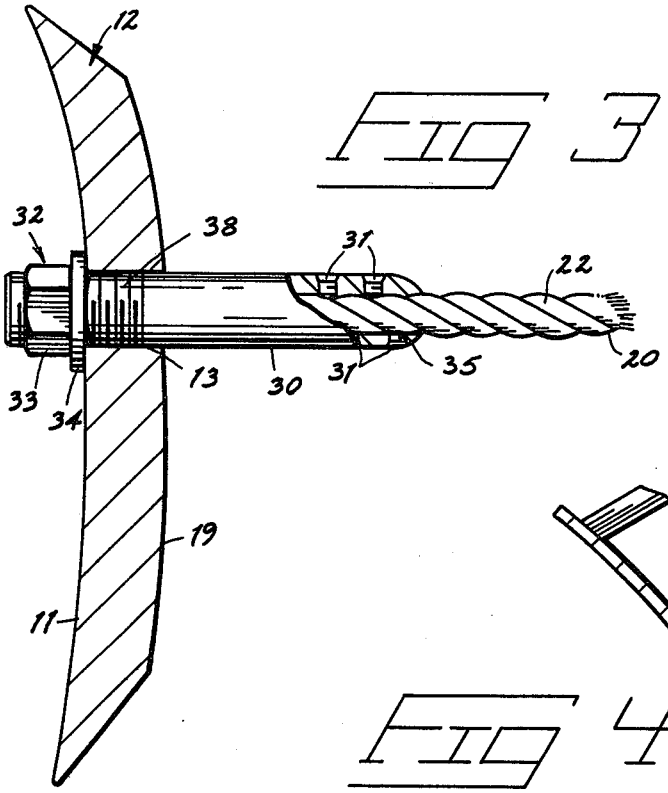
FIG. 3 is a detailed view of the cable terminal.
Figure 4:
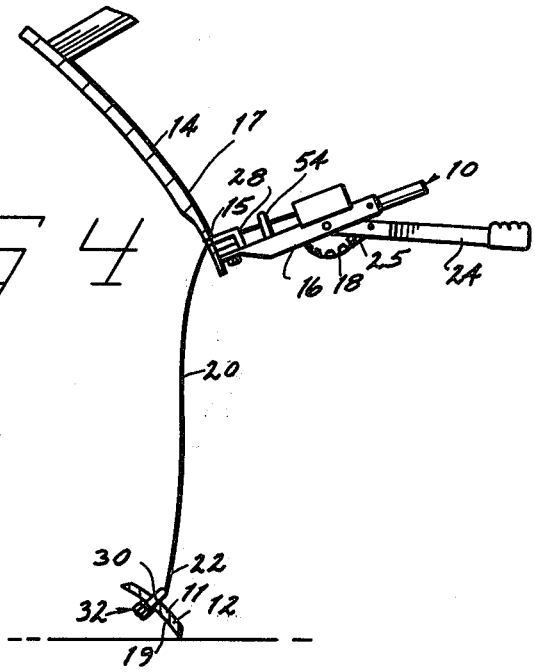
FIG. 4 shows the invention in operation.

The present invention provides an improved tool and method for attaching and removing moldboard bits to and from a moldboard on a piece of agricultural or construction machinery.

The moldboard bit installing tool 10 is used to install an elongated apertured bit 12 on a similarly apertured moldboard 14. The moldboard bit installing tool 10 is secured to a back surface 17 on the moldboard 14. Studs 28 projecting outwardly from an elongated base section 26 of the tool secure it to the moldboard 14 which has apertures 15 that receive the studs 28.

Stud spacing may be adjusted to accommodate blades and bits having different mounting aperture spacing. Stud spacing is provided for by an adjusting means 29. Adjusting means 29 includes two elongated apertured bars 42 and base frame securing means such as bolts 40 and washers 50. Each bar 42 may include an inward set of apertures 51 near the bar center and an outer set 53 at a bar end opposite the end bearing the stud 28. The sets of blades 51, 53 can be selectively shifted in relation to the winch frame base 26 and fitted over the bolts 40 to change the spacing between studs 28. The preferred spacing between apertures along the bars is such that the spacing between studs 28 is twice the distance between apertures of the bit or moldboard. The cable 20 may thereby be centered between the studs directly over a moldboard aperture, so the cable will wind and unwind freely from the drum without chafing against the winch frame 16.

Figure 5:
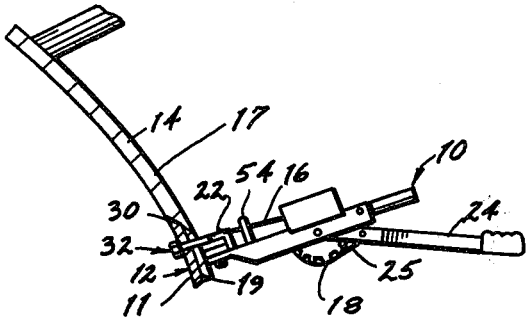
FIG. 5 shows the invention in operation.
Figure 6:
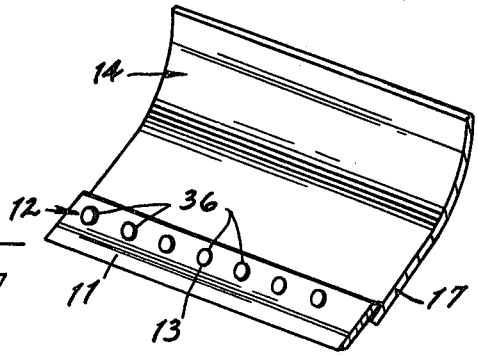
FIG. 6 shows the moldboard and moldboard bit.

The winch cable 20 extends from the tool 10 through a guide loop 54. The cable 20 has a free end 22 that is inserted through an aperture 15 in the moldboard 14 from the back surface 17 of the moldboard. The cable free end 20 is also inserted through a corresponding aperture 13 in the bit 12 from a back surface 11. Fastening means 32 secures the free end 22 of the cable to the bit 12. The fastening means 32 includes a terminal 30 affixed to the free end 22 of the cable 20. At least one set screw 31, threadably received by the terminal 30, secures the terminal 30 to the free end 22 of the cable 20 to allow replacement of the cable without requiring replacement of the terminal 30. The terminal 30 has a projecting threaded shaft end 38 for receiving a washer 34 and threaded nut 33. The terminal 30 is secured by the washer 34 and threaded nut 33 to the bit 12 at the back surface 19 of the bit. The opposite end of the terminal is beveled at 35. The beveled end 35 serves to guide the terminal through the moldboard as the bit is lifted to the mounting position (FIG. 5).

Handle means 24 on the moldboard bit installing tool 10 winds the cable 20 about a winch drum 18 on the tool. The handle means 24 may include a ratchet 25 to secure the winch drum 18 against unwinding. Details of the handle means, winch drum, ratchet and other mechanisms of the general winch assembly are discussed in detail by U.S. Pat. No. 2,506,059 to Maasdam, which is hereby incorporated by reference into this application. The winch drum 18, handle 24, and base section 26 are mounted to the winch frame 16.

Operating the handle 24 hoists or lowers the bit 12 to or from a mounting position in relation to the moldboard 14. The bit 12 is bolted into position by installing bolts 36 through the apertures 13 and 15 in the bit 12 in moldboard 14.

In the prior art, a bit is held by two workers while a third worker installs bolts to secure the bit to the moldboard. In the present method, a worker may use the bit installing tool to lower the old bit and to hoist a new bit to the mounting position. The tool also holds the bit in position while he removes and installs the bolts.

The present tool can be used to remove an old bit from a moldboard. This is done by first removing the bolts from apertures in the bit and moldboard where the studs and cable are to be received. The tool is then installed on the back surface of the moldboard with the terminal extending through the appropriate open apertures. The washer and nut are then threaded onto the threaded shaft end of the terminal until the washer fits snug against the front face of the bat. The remaining bolts can then be removed to free the bit from the moldboard. Finally, the winch handle and ratchet mechanism can be used to lower the old bit to the ground. When the kit is on the ground, the nut and washer can be removed to allow detachment of the cable.

To install the bit 12 to the moldboard, the moldboard bit installing tool 10 is secured to a back surface 17 of the moldboard 14 by inserting the outwardly projecting studs 28 on the elongated base section 26 of the tool into mating apertures in the moldboard. The free end 22 of the winch cable 20 is inserted through an aperture 15 in the moldboard 14 from the back 17 of the moldboard and through a corresponding aperture 13 in the bit 12 from a back surface 11 of the bit 12.

The cable free end 22 is secured to the bit 12 by fastening the terminal 30 to the bit 12 by the nut 33 and washer 34 at the front surface 19 of the bit. The bit 12 is hoisted into mounting position by operating the handle 24 that winds the cable 20 about the winch drum 18.

The bit 12 is bolted into position by installing the bolts 36 through apertures 13 and 15 in the bit 12 and moldboard 14. The cable free end 22 is removed from the bit 12 by removing the nut 33 and washer 34 and by pulling the cable and terminal back through the aligned apertures. The tool 10 is removed from the moldboard 14 by disengaging the tool studs 28 from the moldboard. Finally, bolts 36 are installed through the apertures remaining in the moldboard 14 where the tool studs 28 and cable free end 22 had been.

We claim:

1. A method for bolting an elongated apertured bit having front and back surfaces to a similarly apertured moldboard having front and back surfaces with a moldboard bit installing tool comprising:

securing the moldboard bit installing tool to a back surface of the moldboard by inserting studs outwardly projecting from an elongated base of the tool into mating apertures in the moldboard;

inserting a free end of a winch cable from the tool through an aperture in the moldboard from the back of the moldboard and through a corresponding aperture in the bit from a back surface of the bit;

securing the cable free end to the bit by fastening a terminal affixed to the cable free end to the bit at a front surface of the bit;

hoisting the bit into mounting position in relation to the moldboard by operating a handle means that winds the cable about a winch drum;

bolting the bit into position by installing bolts through the apertures in the bit and moldboard;

removing the cable free end from the bit by releasing the terminal affixed to the cable free end from the bit front surface;

removing the bit inserting tool from the moldboard by disengaging the tool studs from the moldboard;

installing bolts through apertures in the moldboard and bit previously occupied by the tool studs and cable.

2. A moldboard bit installing tool for hoisting and lowering an elongated, apertured bit to and from a mounting position in relation to a similarly apertured moldboard, said tool comprising:

a winch frame;

a winch drum rotatably mounted to the winch frame;

winch cable on the winch drum, the cable extending to a free end;

handle means operably connected to the winch drum for forcibly rotating the winch drum to wind and unwind the cable on the drum;

an elongated base frame mounted to the winch frame;

outwardly projecting studs on the base frame, each stud spaced from one another by a multiple of a distance corresponding to spacing between apertures along the moldboard;

the studs being received through appropriate moldboard apertures such that the winch drum and cable are in alignment with an aperture in the moldboard;

a cable terminal affixed to the free cable end and adapted to be inserted through corresponding moldboard and moldboard bit apertures; and means on the cable terminal for releasably securing the cable terminal to the moldboard bit through an aperture thereof.

3. A moldboard bit installing tool, as defined in claim 2, wherein the elongated base frame further comprises:

means for adjusting the stud spacing to correspond to different spacings between the apertures on different moldboards.

4. A moldboard bit installing tool for hoisting an elongated, apertured bit into mounting position in relation to a similarly apertured moldboard, said tool comprising:

a winch frame;

a winch drum rotatably mounted to the winch frame;

winch cable on the winch drum, the cable extending to a free end;

a ratchet handle pivotally mounted to the winch frame and operably connected to the winch drum for forcibly rotating the winch drum to wind and unwind the cable on the drum;

an elongated base frame mounted perpendicular to the winch frame;

outwardly projecting studs on the base frame, each stud spaced from one another by twice the distance corresponding to spacing between apertures along the moldboard;

the studs being received through appropriate moldboard apertures such that the winch drum and cable are in alignment with an aperture in the moldboard between the two apertures engaged by the studs;

a cable terminal affixed to the free cable end and adapted to be inserted through corresponding moldboard and moldboard bit apertures; and means on the cable terminal for releasably securing the cable terminal to the moldboard bit through an aperture thereof.

5. A moldboard bit installing tool, as defined in claim 4, wherein:

the cable terminal includes a set screw threadably received therein for securing the cable terminal to the cable free end; and the securing means includes:

(a) a threaded shaft projecting from the cable terminal;

(b) a washer engaging the threaded shaft;

(c) a nut threadably receivable on the threaded shaft for retaining the washer and for releasably securing the cable terminal to the moldboard bit through an aperture thereof.

6. A moldboard bit installing tool, as defined in claim 4, wherein the winch frame includes an apertured base and wherein the elongated base frame further comprises:

a first elongated bar having at least one aperture formed through one end and one of the outwardly projecting studs adjacent its remaining end;

a second elongated bar having at least one aperture at one end complementary to the aperture of the first elongated bar and having another of the outwardly projecting studs adjacent a remaining end opposite that of the first elongated bar;

base frame securing means for securing the first elongated bar to the second elongated bar and for securing both bars to the base of the winch frame by insertion of the base frame securing means through the apertures in the bars and apertures in the base of the winch frame, the bars being extendable along their length and securable by the base frame securing means at the apertures therein at points along the bar lengths for adjusting the stud spacing to correspond to different spacings between the apertures on different moldboards.

7. A moldboard bit installing tool, as defined in claim 5, wherein the winch frame includes an apertured base and wherein the elongated base frame further comprises:

a first elongated apertured bar having at least one aperture adjacent one end and one of the outwardly projecting studs adjacent its remaining end;

a second elongated bar having at least one aperture adjacent one end complementary to the aperture of the first elongated bar and having another of the outwardly projecting studs adjacent its remaining end opposite that of the first elongated bar;

base frame securing means for securing the first elongated bar to the second elongated bar and for securing both bars to the base of the winch frame by insertion of the base frame securing means through the apertures in the bars and apertures in the base of the winch frame, the bars being extendable along their length and securable by the base frame securing means at the apertures therein at points along the bar lengths for adjusting the stud spacing to correspond to different spacings between the apertures on different moldboards.

* * * * *